US006126632A

United States Patent [19]

Verbovszky et al.

[11] Patent Number: 6,126,632

[45] Date of Patent: Oct. 3, 2000

[54] GRAVITY CUP WITH ADJUSTABLE, INTERCHANGEABLE AND DISPOSABLE TUBE STRAW VALVE

[76] Inventors: Esther Verbovszky, 325 N. Falmouth Dr., Rocky River, Ohio 44116; Carl J. Myers, 7816 Little Mountain Rd., Mentor, Ohio 44060

[21] Appl. No.: 09/275,164

[22] Filed: Mar. 24, 1999

[51] Int. Cl.[7] ..... A61J 7/00

[52] U.S. Cl. ..... 604/78; 220/712; 239/26; 239/37

[58] Field of Search ..... 604/78, 80; 222/484, 222/536; 220/710; 239/26, 29, 37

[56] References Cited

U.S. PATENT DOCUMENTS

| | | | |
|---|---|---|---|
| 4,485,963 | 12/1984 | Panicci | 227/7 |
| 4,573,631 | 3/1986 | Reeves . | |
| 4,588,396 | 5/1986 | Stroebel . | |
| 4,856,995 | 8/1989 | Wagner | 433/215 |
| 5,199,633 | 4/1993 | Jantzen et al. . | |
| 5,242,079 | 9/1993 | Stephens et al. | 220/705 |
| 5,484,405 | 1/1996 | Edstrom, Sr. | 604/77 |
| 5,662,268 | 9/1997 | Katzenberger . | |
| 5,699,937 | 12/1997 | Canela | 222/129 |

OTHER PUBLICATIONS

AliMed Therapy Division Catalog, Spring 1999 Cover and p. 27.

*Primary Examiner*—Sharon Kennedy
*Assistant Examiner*—Eric Kline

[57] ABSTRACT

A gravity cup for drinking fluids, comprising a container defined by sides connected to a base on one end and forming an opening at the other end through which fluid is placed and contained therein, the container having an outlet located at the base such that gravity forces the fluid through the outlet; a valve being ball-shaped and having a passage therethrough in rotationally attached to the container such that rotating the valve regulates the flow of fluid out of the container through the outlet; the valve being operable from fully opened, through partially opened, through fully closed; position an adjustable tube straw connected at its proximal end to the valve such that fluid flowing through the valve flows through the adjustable tube straw to a user for drinking at its distal end, and such that manipulating the adjustable tube straw rotates the ball thereby operating the valve and regulating the rate of flow of fluid from the container through the passage and the adjustable tube straw to the user.

23 Claims, 5 Drawing Sheets

GRAVITY CUP WITH ADJUSTABLE, INTERCHANGEABLE AND DISPOSABLE TUBE STRAW VALVE

BACKGROUND OF THE INVENTION

1. Field of the Invention

The present invention relates, generally, to drinking cups and, more particularly, to drinking cups with gravity-aided means for dispensing fluids to individuals with physical or mental impairments.

2. Description of Related Art

Individuals with physical impairments or neurological disorders may exhibit difficulties with eating and/or drinking, swallowing or sucking fluids. This impairment or disorder is generally termed, dysphagia, which, in its broadest sense relates to an eating or drinking dysfunction and, in a more limited sense, defines a swallowing dysfunction. The act of eating and/or drinking, though, involves a complex interplay of physiological mechanisms, both physical and neurological; voluntary and reflexive. As such, dysphagia can result from either and or both a physical impairment or a neurological disorder, and effective treatment must identify and take into account the cause or causes of the dysphagia.

The eating and drinking process begins with the ability to control the intake of a bolus, fluid or solid, into the mouth. Voluntary actions then coordinate processing of the bolus while in the mouth, e.g., chewing, tongue manipulation etc. Voluntary swallowing begins with the movement of the bolus to the posterior of the mouth. At a certain point, involuntary (reflexive) swallowing begins involving two separate phases, the pharyngeal phase and the esophageal phase. The pharyngeal phase generally, describes the movement of the substance from the pharynx to the esophagus while the esophageal phase describes the movement of the through the esophagus.

Physical impairments and neurological disorders can result in both voluntary and reflexive dysfunctioning. Physical impairments can be due to back, neck, mouth, or other physical injuries or conditions, such as cerebral palsy, which make it difficult to either swallow or to raise or tilt the head to drink from a glass or suck from a straw. This may be especially pronounced when the physical condition affects the lips, tongue, pharynx or esophagus.

Neurological disorders, such as a stroke; progressive neurological disorders, such as Parkinson's disease; physiological brain changes from Alzheimer's or other dementia, or severe retardation to name just a few conditions, can result in an individual not knowing how to drink, actually forgetting to drink and/or not being physically able to drink from a cup. The individual is not able to monitor and/or control the amount and rate of flow of fluid into the mouth. These conditions may be the result of a propriocepter dysfunction. The swallowing stimuli is either not being produced or is produced and, for some reason, is not activating the sensory receptor in the muscles and tendons controlling the eating or drinking process. This may also be the resultant of a neurological impairment.

In such cases serious and severe effects can result. For instance, dehydration may occur, if a person forgets to drink secondary to limited head movement or cannot drink and aspiration may result if a person cannot monitor or control the drinking due to neurological deficits. In addition, assisting a person with an impairment to drink may be difficult, time consuming and messy for a caregiver. Spillage is prevalent with existing cups with the necessity to not only clean-up the actual spill, but, also, the individual and his or her clothes and bed.

Effectively treating dysphagia, requires first determining its cause or causes. Dysphagia resulting from physical impairment may mandate a physiological corrective procedure, e.g. surgery, prior to any therapy. Neurological disorders, on the other hand may manifest in a loss of neurological control over swallowing, in which event a program of swallowing therapy may immediately implemented. In either situation, the therapy must be carefully designed, taking into account the extent and character of the impairment and/or disorder and the personality, age and other aspects of the individual patient. Devices utilized in such therapy must be designed to accommodate such factors and be effective.

There have been many attempts to provide devices to aid individuals with these impairments. In U.S. Pat. No. 5,662,268, to Katzenberger, describes a device which includes a manual pump mechanism which, alternatively, draws fluid from a source, like a cup, into a reservoir, then forces the predetermined volume of fluid from a reservoir through a straw to the user. This device relies on the mechanical action of the pumping mechanism and not gravity to aid the user. Also, it requires a separate pumping action of the caregiver to operate.

A similar device is marketed by AliMed Inc. under the name People Feeder. This device is used to provide thick soups or pureed food to a user. Like the Katzenberger device, it requires a mechanical pumping action of the caregiver with any further control of fluid flow accomplished by manually squeezing a feeding tube.

AliMed Inc. also markets a Gravity Assisted Drinking Cup which is a 8 oz. cup with a collar in the side by the bottom, in which a standard straw is inserted. Controlling the fluid flow is accomplished by tilting the cup or squeezing the straw. Although a mechanical pump is not employed with this device, the necessity to manually squeeze the tubing is retained. Additional devices marketed by AliMed Inc. include a Dysphagia Cup and Nosey Cup which have contours or cut-outs, respectively, to aid users with impairments.

Maddak, Inc. markets a cup entitled the Flo-Trol Invalid Vacuum Feeding Cup which dispenses fluid through a mouthpiece when a rubber button is depressed by the user. The device utilizes a vacuum to urge the fluid through the mouthpiece.

None of these devices provides a cup which, is adjustable to control the rate and volume of fluid flow as well as, the angle of fluid delivery to a user by utilizing gravity, is consistently accurate in the rate and volume of fluid flow from use-to-use, nor can be effectively incorporated into a program of therapy and/or rehabilitation for a user with a drinking or swallowing disorder.

There exists, therefore, a need for such a device.

BRIEF SUMMARY OF THE INVENTION

The present invention provides a system to satisfy the aforementioned need.

An object of the present invention is to provide a gravity cup which is easy and simple to operate by a user, caregiver or therapist.

Another object of the present invention is to provide a gravity cup which is adjustable to control the rate and volume of flow of fluid to a user.

Still another object of the present invention is to provide a gravity cup which is adjustable to control the angle of delivery to the user without tilting the cup.

Still another object of the present invention is to provide a gravity cup which precludes any spillage of fluid while in use or during storage even with fluid remaining in the cup.

Still another object of the present invention is to provide a gravity cup that is constantly accurate in the rate and volume of fluid flow from use-to-use.

Still another object of the present invention is to provide a gravity cup which can be effectively incorporated into a program of therapy and/or rehabilitation for a user with a drinking or swallowing disorder.

Accordingly, the present invention relates to a gravity cup for drinking fluids, comprising a container for holding the fluid, the container having an outlet; a valve attached to the container at the outlet such that gravity forces the fluid in the container into continual contact with the valve through the outlet and such that the valve operates from fully opened, through partially opened, through fully closed thereby regulating the rate of flow of fluid out of the container through the valve; an adjustable tube straw attached to the valve such that fluid flowing through the valve flows through the adjustable tube straw to a user for drinking, and such that the position of the adjustable tube straw controls the operation of the valve thereby regulating the rate of flow of fluid to the user.

In another aspect, the present invention relates to a gravity cup for drinking fluids, comprising a container defined by sides connected to a base on one end and forming an opening at the other end through which fluid is placed and contained therein, the container having an outlet located at the base such that gravity forces the fluid through the outlet; a valve being ball-shaped and having a passage therethrough rotationally attached to the container such that rotating the valve regulates the flow of fluid out of the container through the outlet, the valve operating from fully opened, through partially opened, through fully closed; an adjustable tube straw connected at its proximal end to the valve such that fluid flowing through the valve flows through the adjustable tube straw to a user for drinking at its distal end, and such that manipulating the adjustable tube straw rotates the ball thereby operating the valve and regulating the rate of flow of fluid from the container through the passage and the tube straw to the user.

In still yet another aspect, the present invention relates to an improvement to a container for drinking fluids The improvement comprises an adjustable tube straw attached to the container such that the fluid in the container flows from the container through the adjustable tube straw to a user, the flow of fluid through the adjustable tube straw controlled by manipulating the adjustable tube straw by changing the angle of the adjustable tube straw with respect to the container.

BRIEF DESCRIPTION OF THE SEVERAL VIEWS OF THE DRAWINGS

Further features of the present invention will become apparent to those skilled in the art to which the present invention relates from reading the following specification with reference to the accompanying drawings in which.

DETAILED DESCRIPTION OF THE INVENTION

Figure 1:
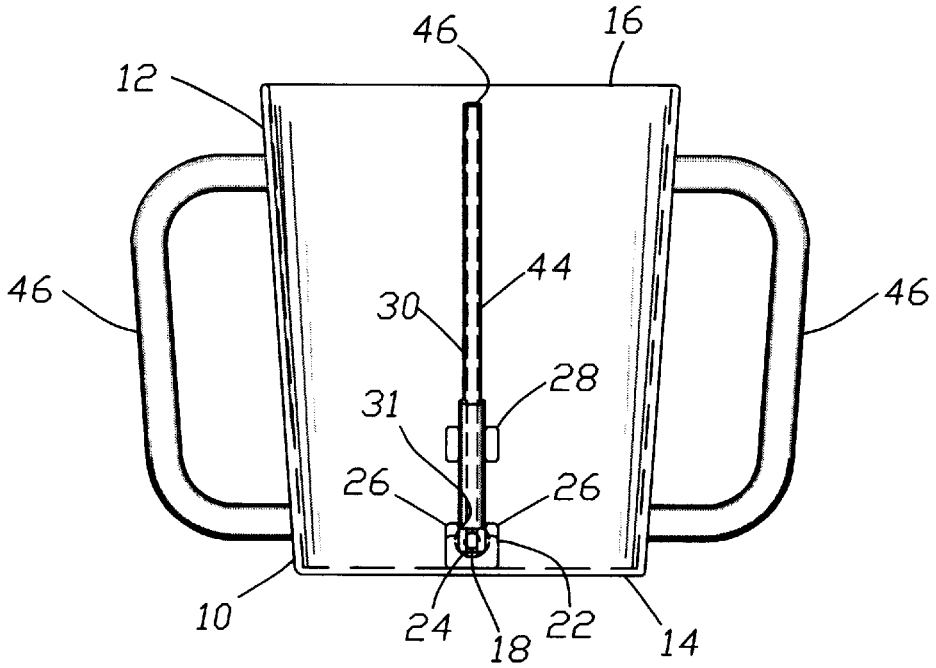
FIG. 1 is a front elevation view of the present invention with the valve closed.
Figure 2:
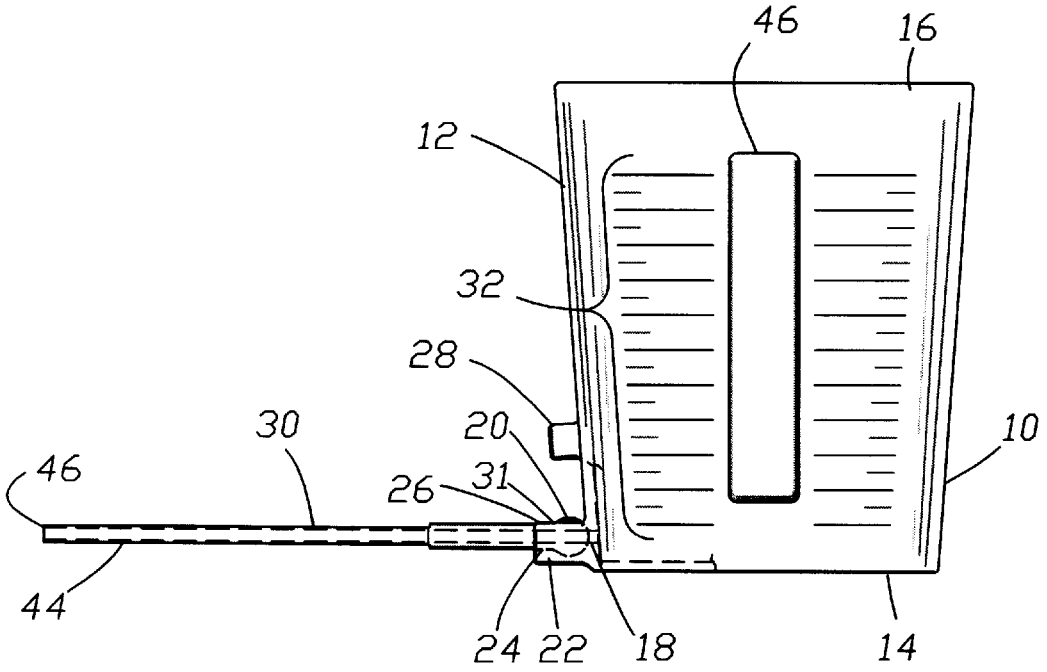
FIG. 2 is a side elevation view of the present invention with the valve opened.

Referring now to the drawings and, more particularly, FIG. 1 and FIG. 2, there are shown a front elevation with the valve closed, and a side elevation with the valve opened, respectively, of the present invention. A container 10 for holding fluid F is defined by a side 12 connecting to a base 14 at one end and forming an opening 16 at the other end through which fluid F is placed and contained in the container 10. The base 14 or opening 16 can be round or oval, as is typical of cups, or can be any other geometrical shape, including square or rectangular. An outlet 18 (shown in phantom) extends through the side 12 at the base 14. A valve seat socket 22 is located on the side 12 at the outlet 18. The valve seat socket 22 has a stop shelf 24 and side grips 26. A retaining clip 28 is located on the side 12 above the outlet 18. The side 12 is constructed of transparent, clear or opaque material such that the fluid in the container 10 can be seen therethrough. Graduations 32 located on the side 12 of the container 10 allow for the visual determination of the amount of fluid F in the container 10. At least one handle 46 attaches to the container 10 to allow it to be held and manipulated. Advantageously, the container 10, valve seat socket 22, handle 46 and retaining clip 28 are of a single molded construction. The container 10 can be disposable.

A valve 20 rotationally positions in the valve seat socket 22. The valve 20 is ball-shaped and is retained in the valve seat socket 22 by side grips 26. An adjustable tube straw 30 connects at its proximal end 31 to the valve 20 and extends therefrom. A fluid passage 44 extends through the valve 20 and the adjustable tube straw 30. Advantageously, the valve 20 and adjustable tube straw 30 are an integral unit of a single molded construction. Manipulating the adjustable tube straw 30 causes the valve 20 to rotate in the valve seat socket 22. As the valve 20 rotates, it remains in communication with the outlet 18 but the angle of the fluid passage 44 with respect to the side 12 moves the fluid passage 44 into and out of alignment with the outlet 18. When the fluid passage 44 is in full alignment with the outlet 18, the valve 20 is fully opened (FIG. 2). When there is no alignment (no portion of the fluid passage 44 aligns with the outlet 18) the valve 20 is fully closed (FIG. 1). Partial alignment of the fluid passage 44 with the outlet 18 results in the valve 20 being partially opened. In this particular design, when the adjustable tube straw 30 is at about a parallel orientation to the side 12, a generally vertical orientation, the fluid passage 44 is not aligned with the outlet 18 and the valve 20 is fully closed. In this position the adjustable tube straw 30 locates in the retaining clip 28. When the adjustable tube straw 30 is at about a perpendicular orientation to the side 12, a generally horizontal orientation, the fluid passage 44 is fully aligned with the outlet 18 and the valve 20 is fully opened.

Figure 3:
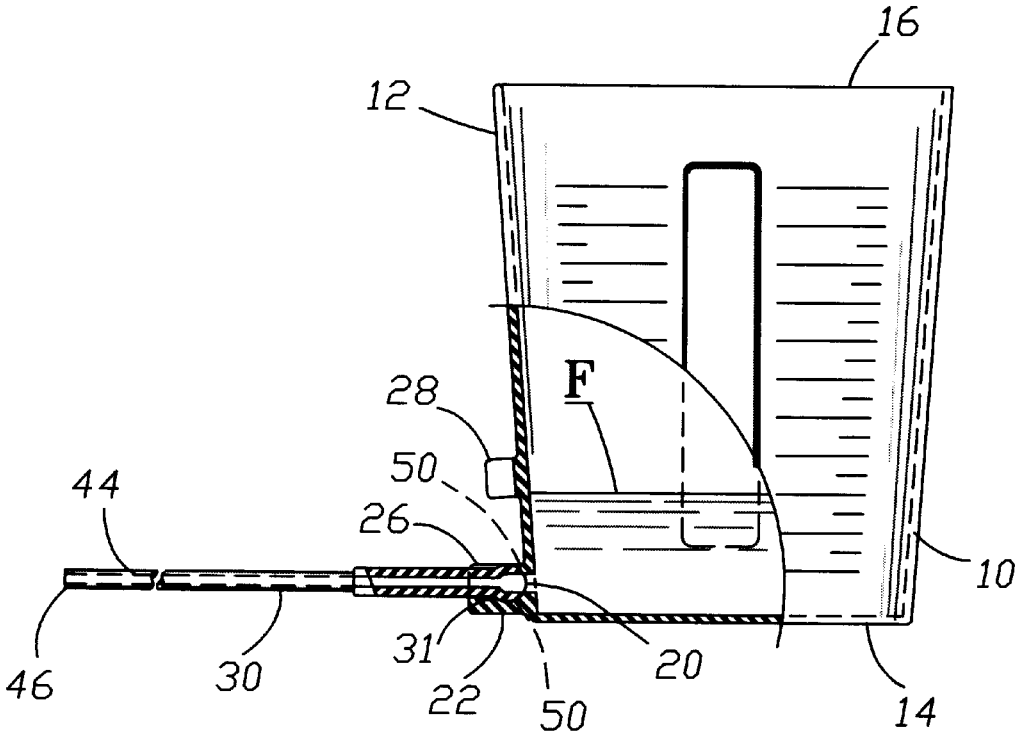
FIG. 3 is a section view of the present invention with the valve opened.

Referring now to FIG. 3, there is shown a section view of the present invention with the valve fully opened; the section cut vertically through FIG. 2. The adjustable tube straw 30 rests on stop shelf 24 which precludes the valve 20 from rotating further in that direction. This assures that the valve remains in the fully opened position when so intended and provides structural support for the adjustable tube straw 30. When the user puts the fluid F into the container 10, gravity forces the fluid F through the outlet 18 and causes the fluid F to be in continual contact with the valve 20 which is in communication with the outlet 18. Gravity forces the fluid F to flow through the outlet 18 and through the fluid passage 44. Seals 50 formed in the valve seat socket 22 seal the valve 20 therein assuring against fluid F leakage around the valve 20 while allowing rotational movement of the valve 20. The seals 50 also assure against any fluid F leakage and/or spillage when the valve 20 is fully closed. The user drinks the fluid F from the distal end 46 of the adjustable tube straw 30. Manipulating the adjustable tube straw 30 between the horizontal and vertical orientation controls the operation of the valve 20 from fully opened through partially opened to fully closed, thereby regulating the rate of flow of the fluid F from the container 10 to the user. The user can also regulate the rate of flow of the fluid F by sucking on the adjustable tube straw 30.

Figure 4:
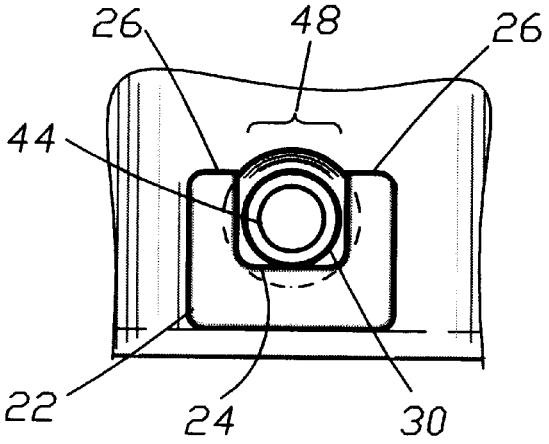
FIG. 4 is a detail view of the valve seat socket.

Referring now to FIG. 4 there is shown a detail view of the valve seat socket 22. The valve seat socket 22 forms around the valve 20 allowing it to rotate in a vertical plane. The side grips 26 extend around the valve 20 leaving a space 48 therebetween large enough for the adjustable tube straw 30 to pass, but small enough to assure that the valve 20 remains in the valve seat socket 22. Urging the valve 20 against the side grips 26 causes them to spread apart increasing the space 48 to a size larger than the valve 20 allowing the placement and removal of the valve 20 in the valve seat socket 22. The side grips 26 are resilient causing them to return to their previous state when the valve 20 is not urged against them. In this manner adjustable tube straws 20 are easily interchanged allowing the use of different lengths and lumen (inside diameter) size adapting the preset invention for different users and applications.

Figure 5A:
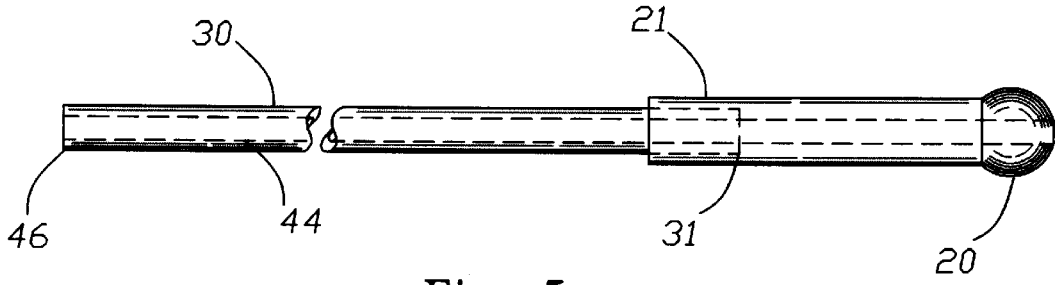
FIGS. 5*a*, 5*b* and 5*c* are detail views of different designs of adjustable tube straws and valves.
Figure 5B:
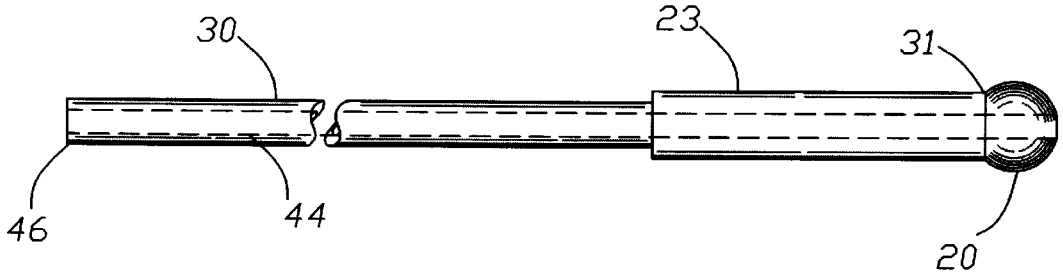
Figure 5C:
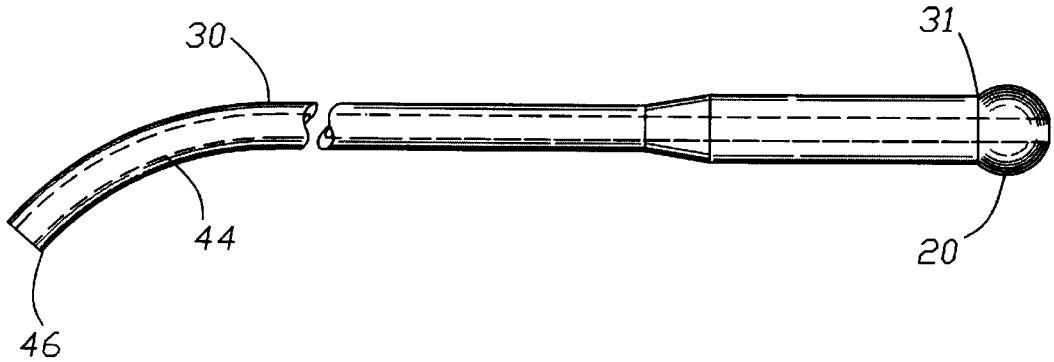

Referring now to FIGS. 5*a*, 5*b* and 5*c*, there is shown three detail views of different adjustable tube straw 30 and valve 20 designs. FIG. 5*a* shows an adjustable tube straw 30 and valve 20, with a separate collar 21. The collar 21 attaches to the valve 20 and is slightly larger than the adjustable tube straw 30. The inside diameter of the fluid passage 44 is sized slightly larger than the outside diameter of the adjustable tube straw 30 such that the adjustable tube straw 30 can fit into the collar 21 tightly enough to seal against any fluid leakage. Adjustable tube straws 30 of different inside diameter can be used interchangeably without changing the collar 21 and valve 20. The outside diameter of the collar 21 is sized to pass between the side grips 26 and to locate and secure in the retaining clip 28 when the valve 20 is fully closed. FIG. 5*b* shows an adjustable tube straw 30 and valve 20 design having a gripping section 23 located at the valve 20. Like the collar 21, the gripping section 23 is sized to pass between the side grips 26 and to locate and secure in the retaining clip 28 when the valve 20 is fully closed. Unlike the collar 21, though, the gripping section 23 has a fluid passage 44 of the same size as that in the adjustable tube straw 30. Advantageously, the adjustable tube straw 30, gripping section 23 and valve 20 are of a single molded construction. FIG. 5c shows a valve 20 and adjustable tube straw 30 with its the distal end 46 curved. The curve may be fixed or, alternatively, the adjustable tube straw 30 can be constructed of flexible material allowing it to bend or curve as needed, to further aid the user in drinking and/or to provide a therapeutic application of the invention for rehabilitative purposes.

The adjustable tube straws 30 can be manufactured in different sizes, e.g. lengths and inside diameters (lumens), suitable for various applications and users making them interchangeable. For example, smaller sized adjustable tube straws can be manufactured for use by children. Also, varying sizes of adjustable tube straws 30 can be used for a particular therapy program to determine a use's progress during rehabilitation. Since the adjustable tube straws 30 are easily removed and replaced, they can also be disposable. The adjustable tube straws 30 can be individually wrapped in sterile packaging thereby promoting sanitary usage and precluding inadvertent transfer and/or reintroduction of infectious agents.

Figure 6:
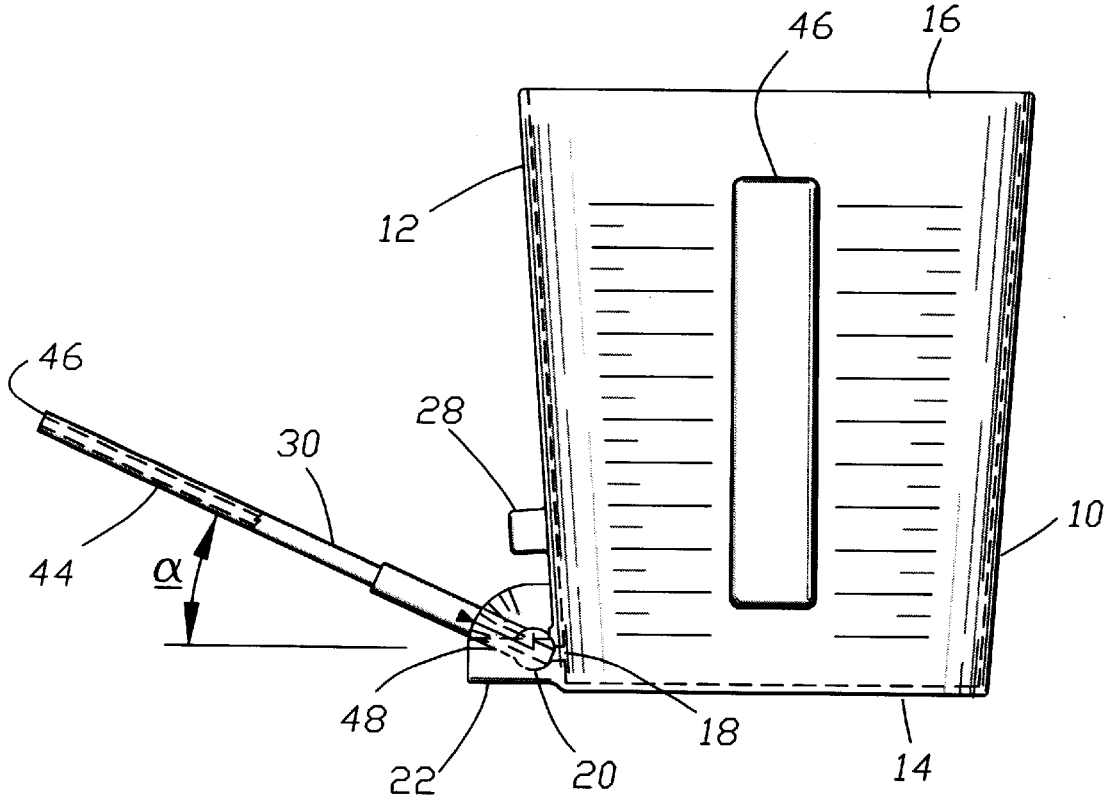
FIG. 6 is an elevation view of a design of the present invention in which the valve seat socket comprises an angle indicating means.
Figure 7:
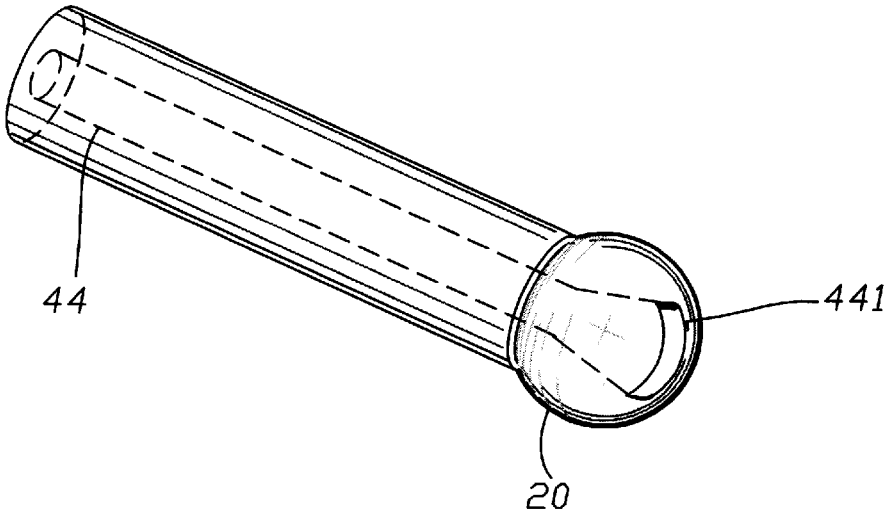
FIG. 7 is a perspective view of a detail of the valve in which the valve provides consistent flow from fully opened to fully closed.

Referring now to FIG. 6, there is shown an elevation view of another design of the present invention. In FIG. 6, the valve seat socket 22 comprises an angle indicating means 48. The angle indicating means 48 has angle marks thereon to accurately indicate the angle $\alpha$ at which the adjustable tube straw 30 is positioned relative to the container 10. This provides the caregiver or therapist a consistently accurate indication of the angle $\alpha$ of the adjustable tube straw 30 between individual uses of the invention. This is important in the design and implementation of rehabilitation and therapy programs. The angle of the adjustable tube straw 30 will affect the amount of sucking pressure the user must exert to get the same amount of flow. As the angle $\alpha$ of the adjustable tube straw 30 increases from the horizontal (the plane of the bottom 14 of the container 10) the affect of gravity on the flow of the fluid "F" out of the container 10 through the adjustable tube straw 30 lessens. The fluid "F" must flow back up from the bottom 14 of the container 10. Also, as the angle $\alpha$ increases, the valve 20 is closing thereby reducing the fluid F flow from the container. The caregiver or therapist can then design a therapy program by first determining a baseline ability of the user, determined at a certain angle $\alpha$, recording that baseline angle $\alpha$ and gradually increasing the angle $\alpha$ to judge the rate of progress of the user. Data of such usage, and the progress for a particular user and for other users can be accumulated and assembled into a database to establish the development of consistent therapeutic rehabilitation programs. Alternatively, as shown in FIG. 7 valve 20 can be constructed to allow a consistent flow between the fully opened and fully closed position. This provides another option for the caregiver or therapist, as it provides for an increase of sucking pressure from the lessening of gravitational effect (increase in angle $\alpha$) only.

Referring now to FIG. 7, there is shown a perspective view of a design of valve 20. Valve 20 has a fluid passage 44 which terminates in a passage opening 441. The passage opening 441 is constructed in a manner so that the outlet 18 remains in full communication with the fluid passage 44. In this way the rate of flow of the fluid is not affected or changed between the fully opened and fully closed positions of the valve 20 but remains consistent therethrough.

Figure 8A:
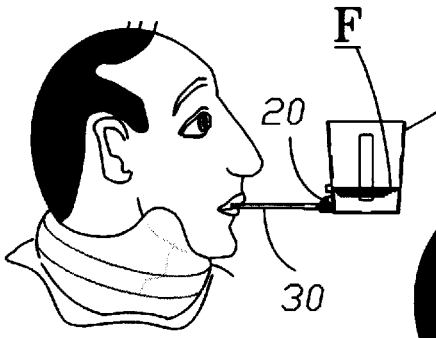
FIGS. 8*a*, 8*b*, and 8*c* are views of a person with a neck injury using the present invention at different angles of the adjustable tube straw in an example of type of therapy program.
Figure 8B:
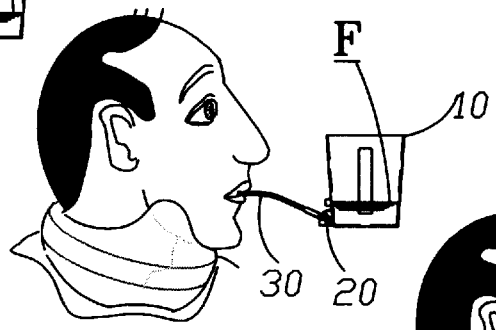
Figure 8C:
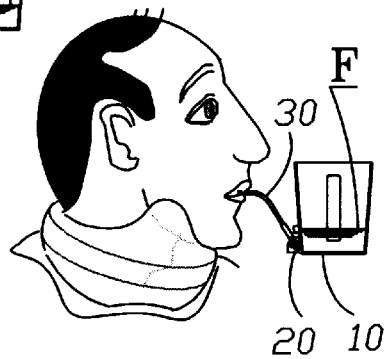

Referring now to FIGS. 8*a*, 8*b* and 8*c*, there is shown views of a person with a neck injury using the present invention in an example of a rehabilitation program. FIG. 8*a* shows an individual using the present invention with the valve 20 fully opened. The adjustable tube straw 30 is essentially horizontal (angle $\alpha$=0°). Individuals with neck injuries have limited or no ability to move or tilt their heads. Since gravity is utilized to force the fluid in the container 10 through the adjustable tube straw 30, and the valve provides a positive control on the rate and volume of flow, the user can remain in the position and still receive fluids. This may be the manner in which the caregiver or therapist determines a baseline ability for the user. Alternatively, in situations not involving a therapy program, usage by bedridden individuals, for example, this can be the manner in which such individuals receive fluids without leaving the bed or even sitting-up. This effectively aids the user in receiving the appropriate fluids and precludes spillage and associated problems associated therewith.

FIG. 8*b* shows an individual using the present invention with the adjustable tube straw 30 angled (angle $\alpha$=30°, for example). The user must apply more sucking pressure to force the fluid "F" to flow from the container 10 and through the adjustable tube straw 30. The caregiver or therapist can record the angle and the times and days of use at that angle and determine or plot the progress of the therapy. The adjustable tube straw 30 is shown as being flexible, allowing it to bend toward its distal end 46 providing a more comfortable positioning in the use's mouth.

FIG. 8*c* shows an individual using the present invention with the adjustable tube straw 30 angled more than it was in FIG. 8*b* (angle $\alpha$=45° or 60°, for example). Increasing the angle $\alpha$ makes the user apply more sucking pressure than as shown in FIG. 8*b*. As with FIG. 8*b*, the caregiver or therapist can record the angle and the times and days of use at that angle and determine or plot the progress of the therapy. Also, as in FIG. 8*b*, the adjustable tube straw 30 is shown as being flexible, allowing it to bend toward its distal end 46 providing a more comfortable positioning in the use's mouth.

Figure 9:
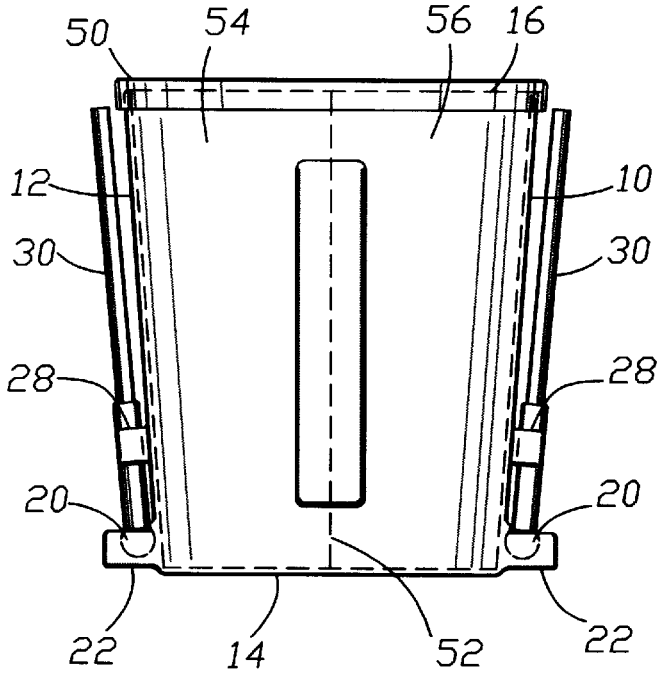
FIG. 9 is an elevation view of the present invention with a plurality of adjustable tube straws.

Referring now to FIG. 9, there is shown an elevation view of the present invention with a plurality of adjustable tube straws 30. Although this FIG. 9 shows two adjustable tube straws 30 any number of adjustable tube straws 30 can be included. This can be preferred if the container 10 is compartmentalized with different fluids in each compartment. This is shown in FIG. 9 by a separator 52 extending through the container 10 dividing it into two separate compartments 54 and 56. Depending on the viscosity of the different fluids F in each compartment 54, 56, adjustable tube straws 30 of different lumen size can be utilized for these fluids F. Also in FIG. 9, the container 10 is shown with a top or cap 50 that can be applied during storage or other non-use times.

While particular embodiments of the invention have been described, those skilled in the art will recognize that many modifications are possible that will achieve the same goals by substantially the same system, device or method, and where those systems, devices or methods still fall within the true spirit and scope of the invention disclosed.

What is claimed is:

1. A gravity cup for drinking fluids comprising:

a) a container comprising a base and an upwardly extending sidewall attached at one end thereof to said base and forming an opening at the other end thereof through which fluid is received, said container having an outlet adjacent said base such that gravity causes said fluid through said outlet;

b) a valve having a ball-shape and having a passage therethrough, said valve being received within said outlet and being rotatable therein, said valve regulating the flow of fluid out of said container through said outlet; and c) an adjustable tube straw having a substantially smooth non-articulated outer surface connected at its proximal end to said valve such that fluid flowing through said valve flows through said adjustable tube straw to a user for drinking to its distal end, manipulation of said adjustable tube straw causing rotation of said valve operating said valve regulating the flow of fluid from said container through said passages and said adjustable tube straw to the user.

2. The gravity cup of claim 1 wherein said wall is constructed of material such that said fluid in said container is seen through said wall.

3. The gravity cup of claim 2 further comprising graduations on said wall such that the volume of fluid can be determined.

4. The gravity cup of claim 1 wherein said valve and said tube straw are an integral unit with said passage extending longitudinally therethrough.

5. The gravity cup of claim 1 further comprising a collar attached to said valve, said collar having a fluid passage with a diameter sized to accept the insertion of said adjustable tube straw therein without any fluid leakage thereabout.

6. The gravity cup of claim 1 wherein said distal end of said adjustable tube straw is curved.

7. The gravity cup of claim 1 wherein said adjustable tube straw is flexible such that said distal end can be bent or curved.

8. The gravity cup of claim 1 wherein said adjustable tube straw is manipulated by changing the angle of said adjustable tube straw with reference to said container.

9. The gravity cup of claim 1 further comprising a plurality of adjustable tube straws.

10. The gravity cup of claim 1 wherein said container is compartmentalized.

11. The gravity cup of claim 1 wherein said container is disposable.

12. A gravity cup for drinking fluids comprising:

a) a container for holding the fluid, said container comprising a base and an upwardly extending sidewall around the perimeter of said base, and an outlet adjacent the junction of said sidewall and said base, b) a valve attached to said container adjacent said outlet such that gravity causes the fluid in said container into a continual contact with said valve through said outlet and such that said valve is operable from a fully opened condition, through a partially opened condition, to a fully closed condition, and vice-versa, thereby regulating the rate of flow of fluid from said container through said valve; and c) an adjustable tube straw having a substantially constant outer diameter and having a substantially smooth non-articulated outer surface attached to said valve such that fluid flowing through said valve flows through said adjustable tube straw to a user for drinking, the position of said adjustable tube straw with respect to said container controlling the operation of said valve thereby regulating the rate of flow of fluid to the user.

13. The gravity cup of claim 12 wherein said valve is ball shaped.

14. The gravity cup of claim 12 further including a retainer clip such that when said valve is in a fully closed condition, said adjustable tube straw is receivable within said retainer clip.

15. The gravity cup of claim 12 further including a stop shelf attached to said valve and oriented such that when said valve is in a fully opened condition, said adjustable tube straw rests on said stop shelf.

16. The gravity cup of claim 12 further comprising graduations on said container and wherein said container is constructed of material such that the amount of fluid in said container can be visually determined.

17. The gravity cup of claim 12 further comprising at least one handle attached to said container such that said container can be held and manipulated.

18. The gravity cup of claim 12 wherein the position of said adjustable tube straw is an angular position with reference to said container.

19. The gravity cup of claim 12 further comprising a plurality of adjustable tube straws.

20. The gravity cup of claim 12 wherein said container is compartmentalized.

21. The gravity cup of claim 12 wherein said container is disposable.

22. A gravity cup for drinking fluids comprising a container for holding the fluid, said container having an outlet, a valve attached to said container at said outlet such that gravity forces the fluid in said container into continual contact with said valve and through said outlet and such that said valve is operable from a fully opened condition, through a partially closed condition, to a fully closed condition, thereby regulating the rate of flow of fluid out of the container through said valve, an adjustable tube straw attached to said valve such that fluid flowing through said valve flows through said adjustable tube straw to a user for drinking, the position of said adjustable tube straw controlling the operation of said valve thereby regulating the rate of flow of fluid to the user, said position of said adjustable tube straw being the angular position of said adjustable tube straw with respect to said container, and angle indicating means such that the angle of said adjustable tube straw with respect to said container can be determined.

23. In combination with a container for drinking fluids, the improvement comprising an adjustable tube straw attached to said container such that the fluid in said container flows from said container through said adjustable tube straw to a user, the flow of fluid through said adjustable tube straw being controlled by manipulating said adjustable tube straw by changing the angle of said adjustable tube straw with respect to said container, and angle indicating means such that the angle of said adjustable tube straw with respect to said container can be determined.

* * * * *